US008109557B1

(12) United States Patent
Salinas

(10) Patent No.: US 8,109,557 B1
(45) Date of Patent: Feb. 7, 2012

(54) VEHICLE ARMOR MAT

(76) Inventor: Gino J. C. Salinas, Riverside, CA (US)

( * ) Notice: Subject to any disclaimer, the term of this patent is extended or adjusted under 35 U.S.C. 154(b) by 1278 days.

(21) Appl. No.: 11/760,024

(22) Filed: Jun. 8, 2007

(51) Int. Cl.
*B62D 25/22* (2006.01)

(52) U.S. Cl. ..... 296/97.23; 296/187.12; 280/770

(58) Field of Classification Search ..... 296/97.23, 296/152, 136.02, 187.03, 187.12; 89/36.02, 89/36.08, 36.09, 36.07, 36.11, 36.12; 428/911; 109/49.5; 280/770
See application file for complete search history.

(56) References Cited

U.S. PATENT DOCUMENTS 5,517,894 A * 5/1996 Bohne et al. ..... 296/39.1
5,531,500 A * 7/1996 Podvin ..... 296/187.07
5,533,781 A 7/1996 Williams
7,040,938 B2 5/2006 Choi
2009/0114084 A1* 5/2009 Thinn et al. ..... 89/36.02
2010/0251883 A1* 10/2010 Naroditsky ..... 296/97.23

FOREIGN PATENT DOCUMENTS

GB 2347112 A 8/2000
GB 2364956 A 2/2002

* cited by examiner

*Primary Examiner* — Lori Lyjak

(57) ABSTRACT

A foldable vehicle floor mat can be used as a ballistic shield when unfolded and attached to a vehicle door. The mat comprises a weather protective layer and an impact-resistant layer. When completely unfolded, the mat covers the length and height of the vehicle door, for which it was designed. The mat is provided with hanging hooks attached to the upper side of the mat, whereby the mat can be hung upon the vehicle door, and a ballast weight attached to the bottom side of the mat, whereby draping the mat across the door is facilitated, and magnetic strips can be provided along the perimeter of the unfolded mat.

10 Claims, 4 Drawing Sheets

VEHICLE ARMOR MAT

BACKGROUND OF THE DISCLOSURE

1. Area of Application

The present disclosure relates to motor vehicle protection means, and more specifically, to a floor mat that can be also used as a ballistic shield device.

2. State of the Art

An armoring assembly known from U.S. Pat. No. 5,533,781 issued on 9 Jul. 1996 to Charles A. Williams, features fibrous material, which is bonded to the upper surface of the floor, and a ballistic panel/blast shield disposed below the floor and spaced from the lower surface of the floor to create an air gap between the panel and floor. Mechanical fasteners secure the panel to the vehicle. Resilient material is disposed between the vehicle and the panel at the fasteners. The panel, air gap, resilient material and flooring provide resistance to blast pressure. The flooring and fibrous material trap flying shrapnel fragments.

Disclosed in UK application 2347112A "Anti-ballistic panel" published on 30 Aug. 2000 and authored by Derrick George Painter is an anti-ballistic panel comprising a laminated structure with a core layer formed from a foamed plastics material, an anti-ballistic textile sheet intimately bonded in face to face contact with the outer strike face of the core layer, and a deformable shield layer intimately bonded in face to face contact with the inner face of the core layer, the shield layer being adapted to prevent a projectile passing therethrough by deforming/stretching to absorb the impact of the projectile. The textile sheet material may be formed from Kevlar fibers. The shield layer may be formed from aluminum alloy. The anti-ballistic panel may be used in the construction of vehicle bodies.

Known from the UK patent application 2364956A published on 13 Feb. 2002 (inventor David Adie) is a ballistic protection shield made up of a first-section ceramic material, which breaks up an oncoming projectile and a second-section polymer fiber material, which arrests fragments of the projectile and the ceramic produced on impact. The first section ceramic material has a surface coating of adhesive and a layer of a high performance polymer fiber, which has tough, elastic properties and which upon projectile impact prevents the ceramic from cracking extensively. The second section polymer fiber material comprises a compacted form of multiple sheet layers. Holes or cavities are introduced to the first section ceramic layer or sub-layers as required to allow an increase in the depth of ceramic material for performance purposes without significantly increasing the product weight. A thin intermediate layer of Kevlar stiffened by epoxy resin may be bonded between the first and second sections for higher levels of protection. Applications include vehicle bodywork and bulletproof vests.

Known from U.S. Pat. No. 7,040,938 issued on 9 May 2006 to Youn Sang Choi is an armored foldaway inflatable floating device (AFIFD) mounted on the front surface and both side surfaces of an amphibious vehicle to provide additional buoyancy. The AFIFD allows safe swimming of the amphibious vehicle, provides rapidity through automated folding and unfolding processes. The AFIFD has a membrane structure having a seal function and a plate structure having protection power, which are organically combined with each other, to provide both a seal function and protection power. The AFIFD is provided with air while being unfolded by the operation of driving means when the amphibious vehicle swims in water, so that the membrane structure and the plate structure are unfolded to form a completely sealed floating space. When the amphibious vehicle does not swim in water, the structures are folded and closed fixed to a vehicle body, so that the amphibious vehicle can run on ground without any difficulty.

A need exists for a simple-in-structure and easy in use and convenient vehicle protection means that can be used as an armor mat, as well as a ballistic shield.

SUMMARY OF THE DISCLOSURE

According to the disclosure, there is provided a foldable vehicle floor mat adapted to be removably attached to a vehicle door when unfolded, to thereby serve as a ballistic shield. When completely unfolded, the mat can cover the length and height of the vehicle door, for which it was designed. The mat comprises a weather protective layer and an impact-resistant layer.

The mat can also comprise hanging hooks attached to the side of the mat, which would be an upper side of the mat when it is unfolded, and a ballast weight attached to the side of the mat, which would be a bottom side of the mat in its unfolded position, and magnetic strips can be placed along the perimeter of the unfolded mat. Additionally, a hook and loop closure and handle can be respectively attached to a middle of the upper and bottom sides of the mat to hold the lower portion of the mat off the ground until fully deployed.

The above-identified features are believed to fulfill the need for a convenient, simple, and easy in use foldable vehicle floor armor mat.

BRIEF DESCRIPTION OF DRAWINGS

Other objects, features and advantages of the disclosure will become apparent to one skilled in the art by reading the following specification and subjoined claims and by referencing the following drawings, in which:

DETAILED DESCRIPTION

Figure 1:
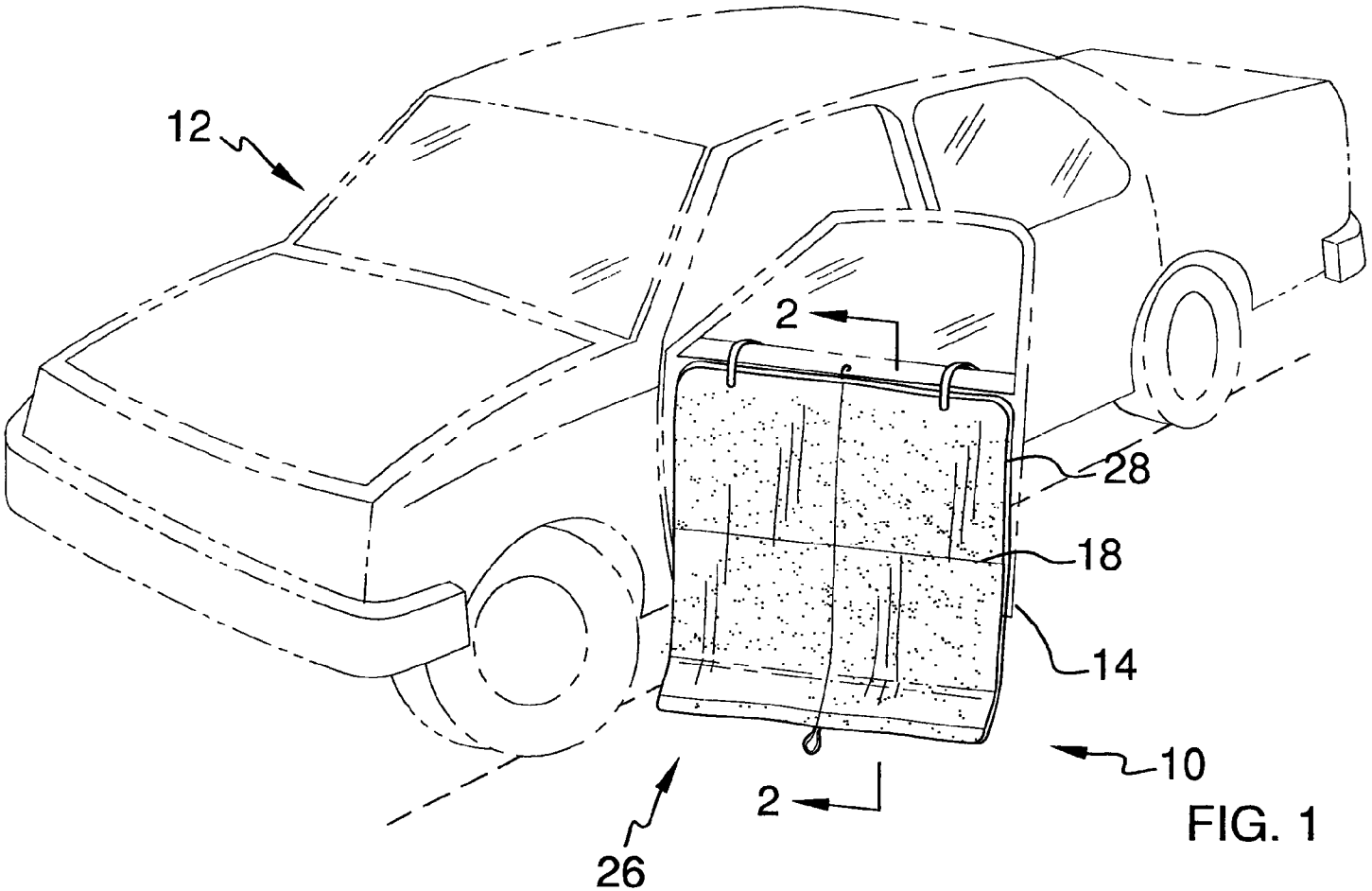
FIG. 1 shows a perspective view of an unfolded floor armor mat deployed onto a door of a vehicle.

Before beginning a detailed description of the disclosure, mention of the following is in order. When appropriate, like reference numerals and characters maybe used to designate identical, corresponding or similar components in differing figure drawings. Further, in the detailed description to follow, exemplary sizes/models/values/ranges may be given, although the present invention is not limited to the same.

Figure 2:
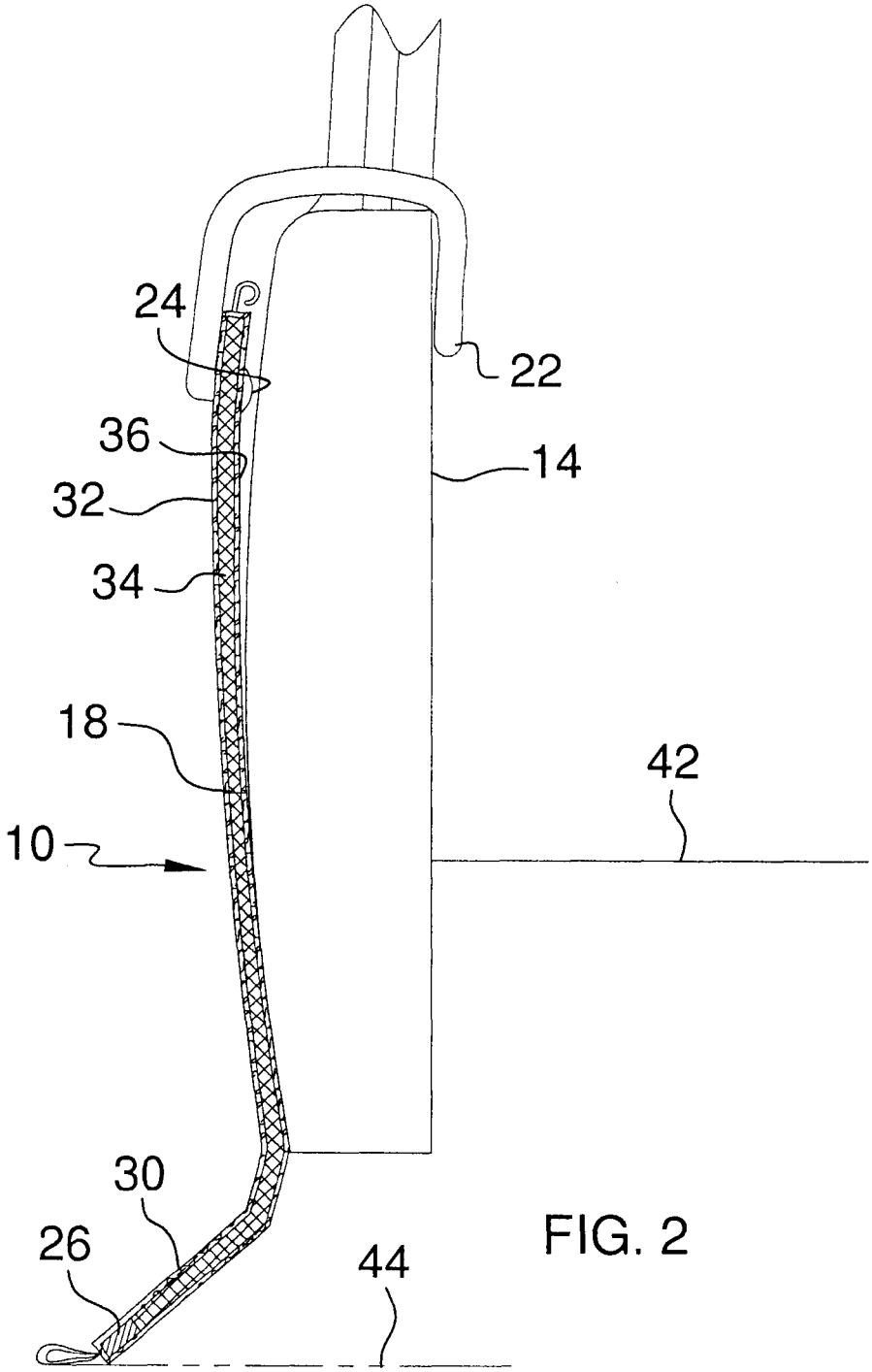
FIG. 2 is a cross-sectional view of the unfolded floor armor mat hanging on the door, as taken along line 2-2 of FIG. 1.
Figure 3:
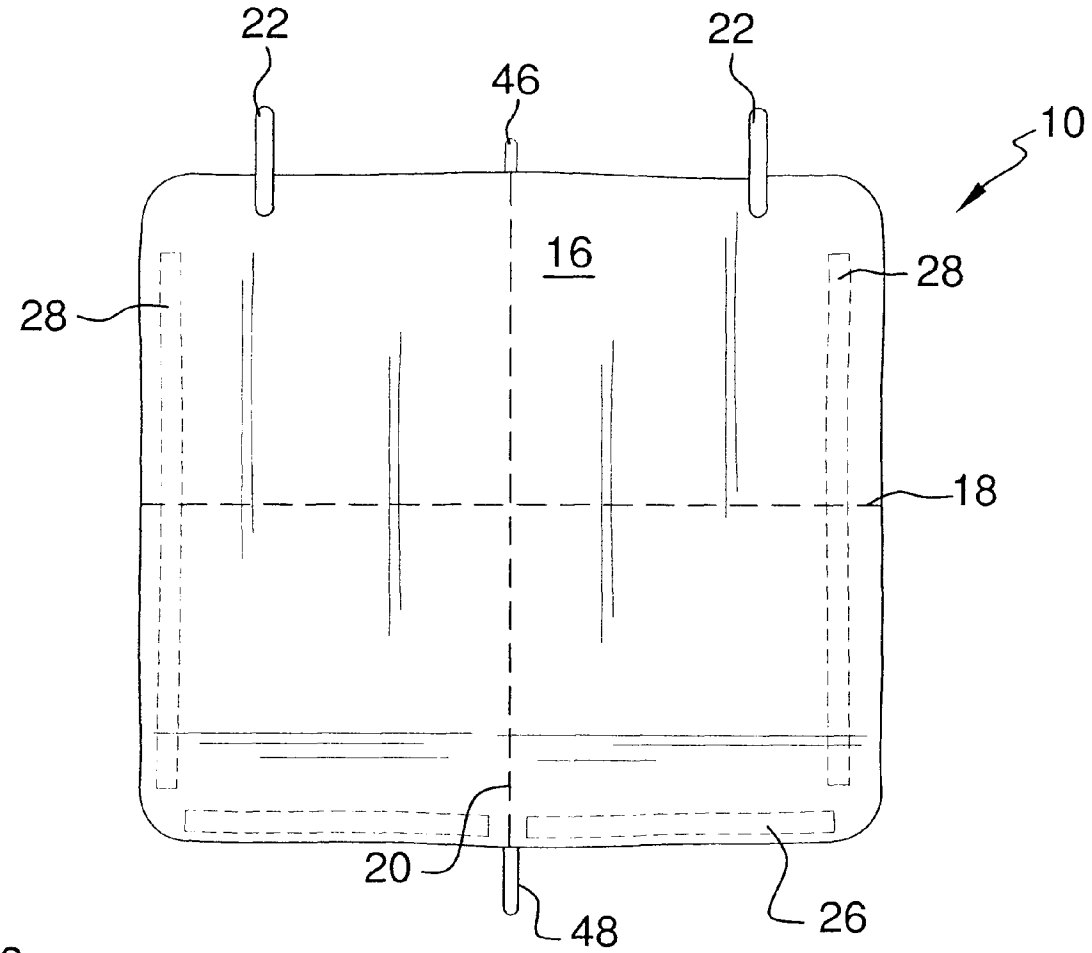
FIG. 3 is a front view of the mat.
Figure 4:
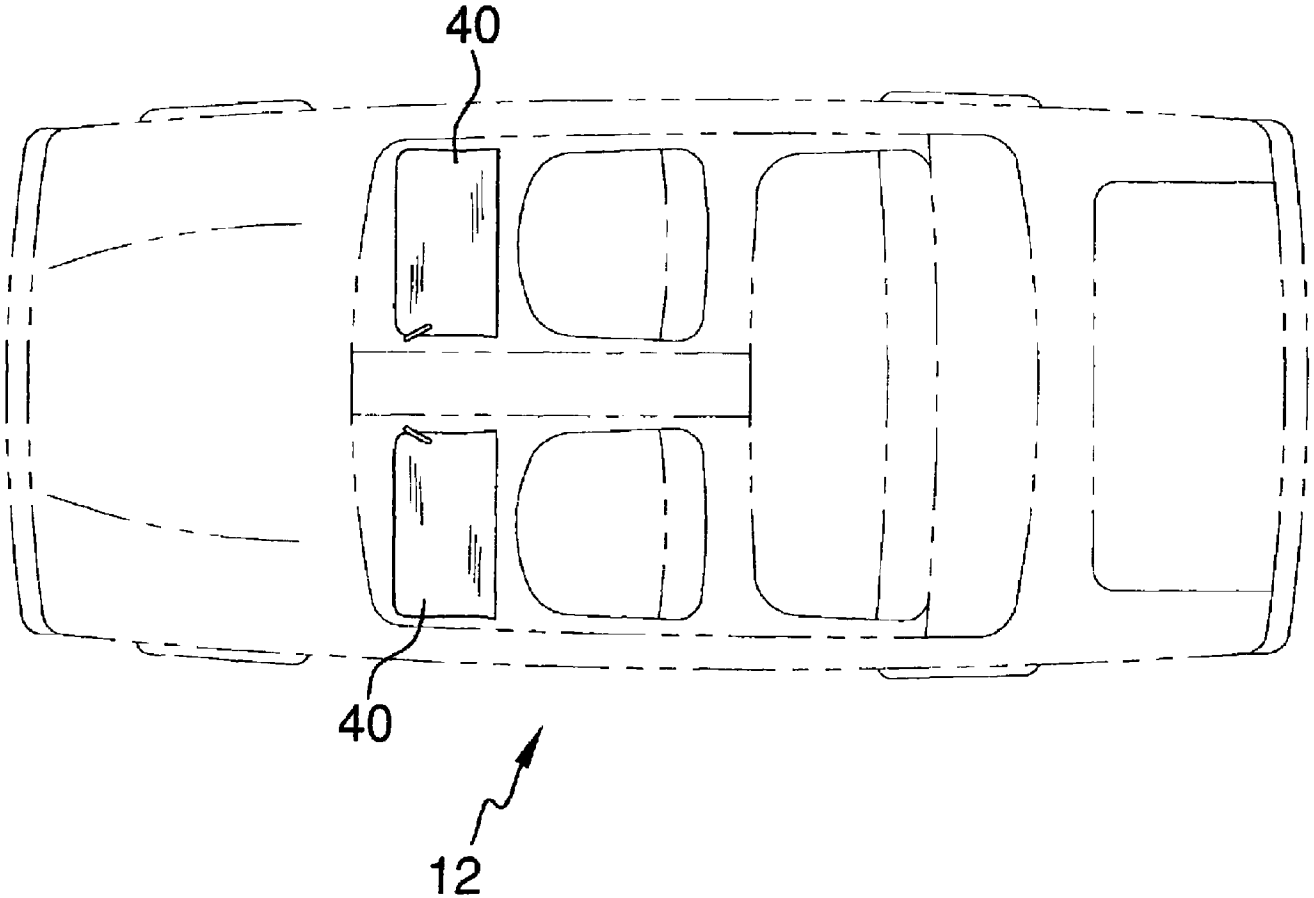
FIG. 4 is a sketch of a vehicle with the mat folded and stored inside the vehicle.

Referring now to FIGS. 1-4, a vehicle foldable armor mat 10 for the use with a vehicle 12 is intended to be hung onto a door 14 when unfolded to thereby function as a ballistic shield device for law enforcement, security, and military personnel.

The mat 10 has a folding main body 16 sized to fit the front and rear floor wells of full size vehicle (Crown Victoria, Hummer, etc.) commonly used in public safety or military applications. The mat can be folded along lines 18, 20, etc. in two, three, or more sections, and when completely unfolded would cover the length and height of the vehicle door, for which it was designed.

The mat is provided with U-shape hanging hooks 22. They can be made of metal or plastic and are attached to the mat in any conventional way, for example by rivets 24. A strip 26 of ballast weight is arranged on the opposite side of the mat, which is its bottom side when the mat is unfolded. The presence of the ballast weight facilitates draping the mat across the outer door skin as the means of providing ballistic protection for the vehicle occupants. Magnetic strips 28 along the perimeter of the unfolded mat could be included to assist in retaining the position of this ballistic shield on a door panel. For even better protection, the overall length of the mat can be selected in such a way that it would have a portion 30 that would lie on the ground in a deployed position of the mat.

The mat 10 comprises at least one weather protective layer 32 and a layer 34 of an impact resistant material. Preferably, a second layer 36 of an inner weather protective material is also provided. For better understanding the effect of the mat, shown in the drawings are also a seat height line 42 and a ground level 44. When installed for exterior ballistic protection on a vehicle door, the mat will offer protection whether the vehicle was moving (½ deployed) or stopped (fully deployed). The vehicle door can also be opened, and the vehicle occupant could crouch behind the door serving as a protective shield in a firefight situation.

In folding the mat 10 to make a floor mat 40 (FIG. 4) out of it, a hook and loop strap 44 and a strap handle 46 can be used. When employed as a floor mat, the mat 10 would also retain its ballistic qualities and be even more effective in trapping shrapnel that may penetrate the vehicle undercarriage. Like other ballistic armor, the mat 10 may come in standard National Institute of Justice grade levels, and options for trauma plates of metal, ceramic, etc. (not shown) may also be contemplated.

It is believed that the armor mat according to the present disclosure would fulfill the need for a means for a useful ballistic shield for public safety or military applications. The appealing features of the mat would be its dual-purpose design as both a ballistic floor mat and ballistic door shield, which may be easily deployed when needed for additional personal protection in public safety or military use situation.

Those skilled in the art can now appreciate from the foregoing description that the broad teachings of the present disclosure can be implemented in a variety of forms. Therefore, while this arrangement has been described in connection with particular example thereof, the true scope of the disclosure should not be so limited since other modifications will become apparent to the skilled practitioner upon a study of the drawings, specification and claims that follow.

What is claimed is:

1. A foldable vehicle floor armor mat adapted to be removably attached to a vehicle door when unfolded, to thereby serve as a ballistic shield.

2. The foldable vehicle floor armor mat as claimed in claim 1, wherein the mat when completely unfolded covers the length and height of the vehicle door, for which it was designed.

3. The foldable vehicle floor armor mat as claimed, in claim 1, wherein the mat comprises a weather protective layer and an impact-resistant layer.

4. The foldable vehicle floor armor mat as claimed in claim 1, further comprising hanging hooks attached to the side of the mat intended to be an upper side thereof upon unfolding the mat, whereby the mat can be hung upon the vehicle door.

5. The foldable vehicle floor armor mat as claimed in claim 1, further comprising a ballast weight attached to the side of the mat intended to be a bottom side thereof upon unfolding the mat, whereby draping the mat across the door is facilitated.

6. The foldable vehicle floor armor mat as claimed in claim 1, further comprising magnetic strips along the perimeter of the unfolded mat.

7. The foldable vehicle floor armor mat as claimed in claim 1, further comprising a hook and loop strap and a strap handle respectively attached to a middle of the sides of the mat intended to be an upper side and a bottom side thereof upon unfolding the mat.

8. A foldable vehicle floor armor mat adapted to be removably attached to a vehicle door when unfolded, to thereby serve as a ballistic shield, the mat comprising hanging hooks attached to the side of the mat intended to be an upper side thereof upon unfolding the mat, whereby the mat can be hung upon the vehicle door, and a ballast weight attached to the side of the mat intended to be a bottom side thereof upon unfolding the mat, whereby draping the mat across the door is facilitated, wherein the mat comprises a weather protective layer and an impact-resistant layer, and wherein the mat when completely unfolded covers the length and height of the vehicle door, for which it was designed.

9. The foldable vehicle floor armor mat as claimed in claim 8, wherein the ballast weight is made magnetic.

10. The foldable vehicle floor armor mat as claimed in claim 8, further comprising a hook and loop strap and a strap handle respectively attached to a middle of the sides of the mat intended to be an upper side and a bottom side thereof upon unfolding the mat.

* * * * *